US007263322B2

(12) United States Patent
Pino et al.

(10) Patent No.: US 7,263,322 B2
(45) Date of Patent: Aug. 28, 2007

(54) FUSER SMART CLEANING AND OILING ASSEMBLY

(75) Inventors: Jason Pino, Rochester, NY (US); Michael P. Leaty, Willamson, NY (US); Kenneth R. Rasch, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 200 days.

(21) Appl. No.: 11/240,606

(22) Filed: Sep. 30, 2005

(65) Prior Publication Data

US 2007/0077103 A1 Apr. 5, 2007

(51) Int. Cl.
*G03G 15/20* (2006.01)

(52) U.S. Cl. ..... 399/325; 399/326; 399/327

(58) Field of Classification Search ..... 399/325, 399/326, 327

See application file for complete search history.

(56) References Cited

U.S. PATENT DOCUMENTS 5,075,732 A * 12/1991 Menjo ..... 399/45
6,035,176 A * 3/2000 Byeon ..... 399/345
2003/0223789 A1* 12/2003 Miyazaki ..... 399/327

* cited by examiner

*Primary Examiner*—Hoang Ngo
(74) *Attorney, Agent, or Firm*—Tallam I. Nguti

(57) ABSTRACT

A smart and virgin contact fuser service assembly is disclosed for servicing a toner fuser assembly and includes (a) a cleaning device including a cleaning member having virgin cleaning portions on a cleaning surface, the virgin cleaning portions being feedable in a single pass into cleaning contact with a fuser first surface of a fuser member being cleaned; (b) an oiling device including an oiling member having virgin oiling portions on an oiling surface, the virgin oiling portions being feedable in a single pass into oiling contact with a second surface of a fuser member being oiled; and (c) a controller connected to the cleaning device and to the oiling device for selectably and controllably feeding the virgin cleaning portions and the oiling portions in response to a measurable condition of the surface of the fuser roll.

20 Claims, 2 Drawing Sheets

FUSER SMART CLEANING AND OILING ASSEMBLY

The present invention relates to a fuser apparatus for an electrostatographic reproducing machine and, more particularly, to such a machine having an improved fuser apparatus including a smart and virgin contact fuser service assembly comprising a controller and a cleaning and oiling assembly for intelligently servicing the fuser assembly.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in imagewise configuration is separated from the photoreceptor and moved through a fuser apparatus to permanently fix or fuse the toner image to the paper.

Typically, a fuser apparatus of the type provides a combination of heat and pressure to fix the toner image on the paper. The basic architecture of a fuser apparatus is well known. Essentially, it comprises a pressure roll that rolls against a rotatable heated fuser roll to form a nip therebetween. A sheet of paper carrying an unfused or powder toner image is passed through the nip. The side of the paper having the unfused or powder toner image typically faces the fuser roll, which is often supplied with a heat source, such as a resistance heater, at the core thereof. The combination of heat from the fuser roll and pressure between the fuser roll and the pressure roll fuses the toner image to the paper, and once the fused toner cools, the image is permanently fixed to the paper.

In most fusing systems in use today as disclosed in the references cited below, there is provided a system by which the fuser roll can be automatically cleaned and/or supplied with a lubricant or release agent. For example, U.S. Pat. No. 6,876,832 issued Apr. 5, 2005 and entitled "Fuser apparatus having cleaning web spooling prevention" discloses a fuser for an electrophotographic printer or copier has a fuser roll and pressure roll that form a nip through which a recording paper having a toner image is passed to fuse the toner image thereon. The fuser includes a cleaning web system to clean the fuser roll having a web supply roll, a tension roll to press the web against the fuser roll, and a web take up roll. To prevent spooling of the web from the supply roll during a paper jam clearance while the pressure roll is in contact with the fuser roll, a torsion spring is mounted on the tension roll shaft. The torsion spring provides enough torsional force on the tension roll to prevent rotation thereof during a jam clearance, thus preventing web spooling. During normal operation, the take up roll intermittently overcomes the torsion spring to step the web thereon.

U.S. Pat. No. 5,749,038 issued May 5, 1998 and entitled "Tension control for a cleaning web in a fuser subsystem in an electrophotographic printer" discloses an architecture of a fuser subsystem in an electrophotographic printer or copier that includes a web which cleans the fuser roll. The web is driven by a mechanism that enables a constant velocity of the web relative to the fuser roll surface without the need of separate motor or controller. The design can further compensate for changes in frictional coefficient between the fuser roll and the web, such as is caused by large deposits of toner collected on the cleaning web.

For high volume reproducing machines, the release agent is typically supplied from an open supply of liquid release agent that is ultimately applied to the fuser roll through one or more donor rollers. In contrast, for mid-volume to low volume reproducing machines, the cleaning and lubrication steps are provided to the surface of the fuser roll by means of a web. The web is urged against the surface of the fuser roll at a location generally away from the nip formed by the pressure and fuser rolls. The web provides a textured surface for removing particles of toner that remained on the fuser roll after the paper with the toner image has passed through the fuser. The web may also provide amounts of lubricant or release agent to the fuser roll. As is well known, the function of the release agent is to prevent sheets of paper that pass through the fuser nip from sticking to the surface of the fuser roll, thus causing a paper jam. In addition, the release agent minimizes the amount of toner that sticks to the fuser roll rather than remaining on the paper.

Generally, in most systems having a web for treating the fuser roll, the web is drawn from a replaceable supply roll and is moved at a reasonably slow rate relative to the movement of the fuser roll. Therefore, the motion of the fuser roll causes the surface of fuser roll to rub against a small area of the web. The relatively slow motion of the web provides friction to the fuser roll surface and provides a supply of clean web at a reasonable rate.

In most prior art designs of a web feeder for a fuser, the web is withdrawn from a supply roll and pulled by and wound on a take up roll. Typically, the take up roll is driven slowly usually at a constant speed and the supply roll idles passively. As such the rate of cleaning and/or the rate of oiling is typically constant even though the condition of the surface of the fuser roll can vary from time to time according to the heaviness or lightness of the toner images fused, as well as according to age. Some prior art systems have proposed providing the necessary slow but continuous motion of the web such as by supplying an external motor separate from the motor driving the fuser roll, or providing a solenoid or ratchet arrangement. It is also known to vary the speed of the take up roll as a function of the circumference of the web on the take up roll increases. Otherwise, if the rotational speed of the take up roll remains constant, the increase in the web circumference will cause a significant increase in the web speed resulting in non-precise cleaning and oiling, as well as in premature web exhaustion.

In accordance with the present disclosure, there is provided a smart and virgin contact fuser service assembly is disclosed for servicing a toner fuser assembly and includes (a) a cleaning device including a cleaning member having virgin cleaning portions on a cleaning surface, the virgin cleaning portions being feedable in a single pass into cleaning contact with a fuser first surface of a fuser member being cleaned; (b) an oiling device including an oiling member having virgin oiling portions on an oiling surface, the virgin oiling portions being feedable in a single pass into oiling contact with a second surface of a fuser member being oiled; and (c) a controller connected to the cleaning device and to the oiling device for selectably and controllably feeding the virgin cleaning portions and the oiling portions in response to a measurable condition of the surface of the fuser roll.

BRIEF DESCRIPTION OF THE DRAWINGS

In the detailed description below, reference is made to the drawings, in which.

DETAILED DESCRIPTION

Figure 1:
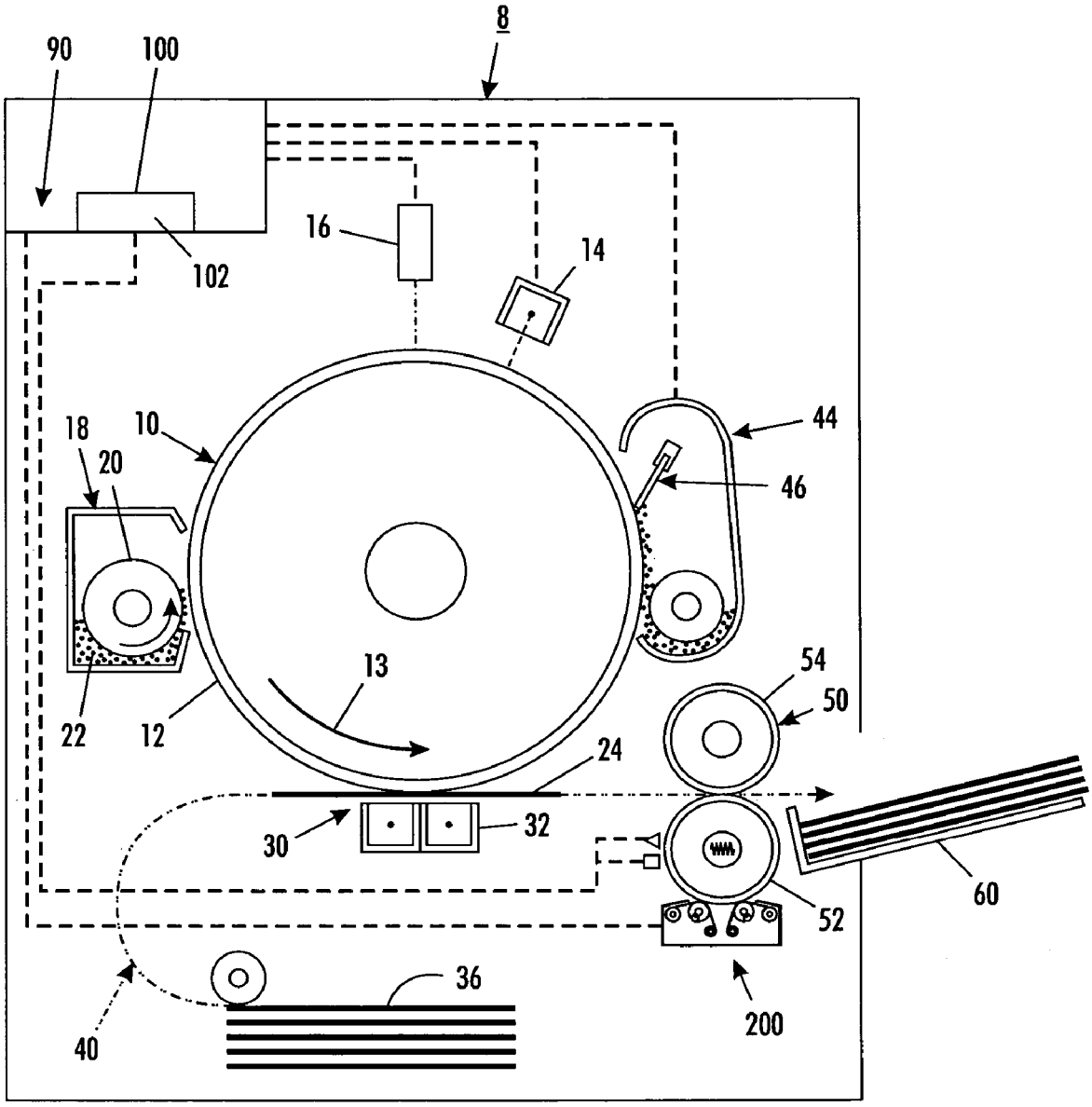
FIG. 1 is a simplified elevational view showing relevant elements of a toner imaging electrostatographic machine including the smart and virgin contact fuser service assembly of the present disclosure.

Referring now to FIG. 1, it is a simplified elevational view showing relevant elements of an electrostatographic or toner-imaging machine 8. As is well known, a charge receptor or photoreceptor 10 having an imageable surface 12 and rotatable in a direction 13 is uniformly charged by a charging device 14 and image-wise exposed by an exposure device 16 to form an electrostatic latent image on the surface 12. The latent image is thereafter developed by a development apparatus 18 that for example includes a developer roll 20 for applying a supply of charged toner particles 22 to such latent image. The developer roll 20 may be of any of various designs such as a magnetic brush roll or donor roll, as is familiar in the art. The charged toner particles 22 adhere to appropriately charged areas of the latent image. The surface of photoreceptor 10 then moves, as shown by the arrow 13, to a transfer zone generally indicated as 30. Simultaneously, a print sheet 34 on which a desired image is to be printed is drawn from a sheet supply stack 36 and conveyed along a sheet path 40 to the transfer zone 30.

At the transfer zone 30, the print sheet 34 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 34. The print sheet 34 is then forwarded to subsequent stations, as is familiar in the art, including the fusing station having a fuser apparatus 50 including the smart and virgin contact fuser service assembly 200 of the present disclosure, and then to an output tray 60. Following such transfer of a toner image from the surface 12 to the print sheet 34, any residual toner particles remaining on the surface 12 are removed by a toner image bearing surface cleaning apparatus 44 including a cleaning blade 46 for example.

As further shown, the reproduction machine 8 includes a controller or electronic control subsystem (ESS), indicated generally be reference numeral 100 which is preferably a programmable, self-contained, dedicated mini-computer having a central processor unit (CPU), electronic storage, and a display or user interface (UI). The ESS 100, with the help of sensors and connections, can read, capture, prepare and process image data such as pixel counts of toner images being produced and fused. As such, it is the main control system for components and other subsystems of machine 8 including the smart and virgin contact fuser service assembly 200 of the present disclosure.

Figure 2:
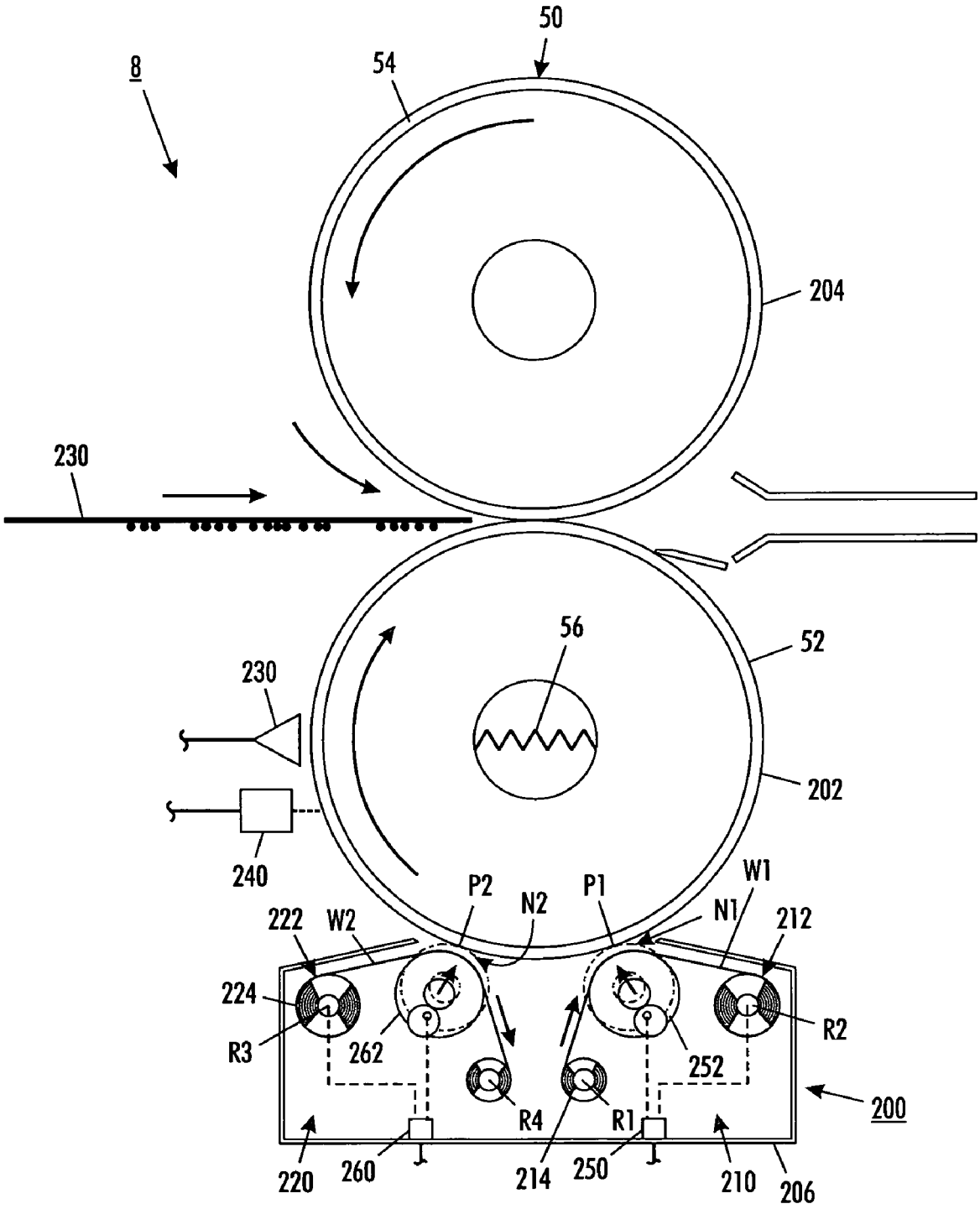
FIG. 2 is an enlarged schematic end view of the fuser apparatus of FIG. 1 showing the essential elements of the smart and virgin contact fuser service assembly of the present disclosure.

Referring now to FIGS. 1-2, the fusing apparatus 50 and the smart and virgin contact fuser service assembly 200 of the present disclosure are shown in detail. As illustrated, the fuser apparatus 50 includes a heated fuser roll 52 heated for example by an internal lamp 56, and a pressure roll 54. The surface 202 of the fuser roll 52 and that 204 of the pressure roll 54 form a fusing nip 58 through which a sheet 24 carrying an unfused toner powder image 25 is fed for fusing and fixing to the sheet.

The smart and virgin contact assembly 200 includes (a) a cleaning device 210 comprising a cleaning member 212 having virgin cleaning portions 214 on a cleaning surface 216 of the member. The virgin cleaning portions 214 are feedable in a single pass into cleaning contact with a first point P1 on the surface of a fusing member, for example, on the surface 202 of the fuser roll 52. The smart and virgin contact assembly 200 also includes (b) an oiling device 220 including an oiling member 222 having virgin oiling portions 224 on an oiling surface thereof. The virgin oiling portions 224 are feedable in a single pass into oiling contact with a second point P2 on the surface of a fuser member, for example, on the surface 202 of the fuser roll 52. As illustrated, the smart and virgin contact assembly 200 further includes (c) control means 90 including the controller 100 that is connected to the cleaning device 210 and to the oiling device 220 for selectably feeding the virgin cleaning portions 214 and the oiling portions 224 in response to a measurable condition of the surface 202 of the fuser roll 52.

The cleaning device 210 as shown comprises a first web assembly 213 and the cleaning member is a first continuous web W1 that includes (i) a first supply roll R1 containing and supplying virgin portions 214 of the first continuous web W1, and (ii) a first take-up roll R2. Any suitable web material capable of withstanding fusing temperatures of the order of about 225° C. may be employed. The web material may be woven or non-woven, so long as it has a surface texture suitable to collect toner from the fuser roll and has a sufficient thickness and strength to prevent the web from being torn when the web is pulled through a cleaning nip N1 by the take up roll R2.

The oiling device 220 as shown comprises a second web assembly 223 and the oiling member 222 is a second continuous web W2 that includes (i) a second supply roll R3 containing and supplying virgin portions 224 of the second continuous web W2, and (ii) a second take up roll R4. The control means 90 for example include sensors 230 and 240 connected to the controller 100 for sensing the temperature and roughness for example of the surface 202 as conditions thereof. The controller 100 that itself includes means 102 for acquiring and measure a quantity of toner fused by the toner fuser assembly over any period of time, as a condition of the toner fuser assembly 50. The controller 100 as such is programmable to selectably feed the virgin cleaning portions 214 and the virgin oiling portions 224 for example on a basis of the measure of a quantity of toner fused by the toner fuser assembly 50 being serviced. The measure of a quantity of toner fused by the toner fuser assembly can comprise a pixel count of toner image pixels formed and fused during a period of time for example.

The smart and virgin contact fuser service assembly 200 also includes a first drive assembly 250 for driving the cleaning device 210 and a second drive assembly 260 for driving the oiling device 220. The second drive assembly 260 is separate from, and controllable independently of, the first drive assembly 250. The first drive assembly 250 and the second drive assembly 260 are each a variable speed drive assembly for allowing the controller to vary the speed thereof responsively as above. The cleaning device 210 further includes a first articulating means 252 for moving the cleaning member 212 into and out of nip (N1) contact with the first surface 202 of the fuser member or roll 52. The oiling device 220 similarly includes a second articulating means 262 for moving the oiling member 222 into and out of nip (N2) contact with the second surface 204 of the fuser member or roll 52.

Thus it can be seen that the smart and virgin contact fuser service assembly 200 includes two independent fuser service web assemblies 210, 220 that may be contained in a common housing 206, and employed to keep the fuser roll 52 of the fuser apparatus 50 clean and free of toner debris which can cause print quality issues. The first nip N1 is the cleaning contact nip and is dry, and the second nip N2 is used for applying oil or release agent onto the cleaned surface 202 of the fuser roll 52. According to an aspect of the present disclosure, pixel count information from the controller 100 is used to control the cleaning and oiling rates of the devices 210, 220 in order to provide better cleaning for difficult images, as well as extend the web lives resulting in lower run cost. Improved cleaning and oiling are important because new and advocated toner materials have been found to have a tendency to generate critical problems involving toner build up in the fuser apparatus. Such build up of toner of course results in the toner being deposited back onto the backs of subsequently fused toner images. Such toner deposited on the stripper finger can also accumulating on the finger and eventually contributing to finger jams.

As can be seen there has been provided a smart and virgin contact fuser service assembly is disclosed for servicing a toner fuser assembly and includes (a) a cleaning device including a cleaning member having virgin cleaning portions on a cleaning surface, the virgin cleaning portions being feedable in a single pass into cleaning contact with a fuser first surface of a fuser member being cleaned; (b) an oiling device including an oiling member having virgin oiling portions on an oiling surface, the virgin oiling portions being feedable in a single pass into oiling contact with a second surface of a fuser member being oiled; and (c) a controller connected to the cleaning device and to the oiling device for selectably and controllably feeding the virgin cleaning portions and the oiling portions in response to a measurable condition of the surface of the fuser roll.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A smart and virgin contact fuser service assembly for servicing a toner fuser assembly, the smart and virgin contact assembly comprising:

(a) a cleaning device including a cleaning member having virgin cleaning portions on a cleaning surface, said virgin cleaning portions being feedable in a single pass into cleaning contact with a fuser first surface of a member being cleaned;

(b) an oiling device including an oiling member having virgin oiling portions on an oiling surface, said virgin oiling portions being feedable in a single pass into oiling contact with a second surface of a fuser member being oiled; and (c) a controller connected to said cleaning device and to said oiling device for selectably feeding said virgin cleaning portions and said oiling portions responsively to a condition of the toner fuser assembly.

2. The smart and virgin contact fuser service assembly of claim 1, wherein said cleaning device comprises a first web assembly and said cleaning member is a first continuous web.

3. The smart and virgin contact fuser service assembly of claim 1, wherein said oiling device comprises a second web assembly and said oiling member is a second continuous web.

4. The smart and virgin contact fuser service assembly of claim 1, wherein said controller includes means for acquiring a measure of a quantity of toner fused by the toner fuser assembly as a condition of said toner fuser assembly.

5. The smart and virgin contact fuser service assembly of claim 1, including a first drive assembly for said cleaning device and a second drive assembly for said oiling device.

6. The smart and virgin contact fuser service assembly of claim 1, wherein said cleaning device includes a first articulating means for moving said cleaning member into and out of nip contact with said first surface of said fuser member.

7. The smart and virgin contact fuser service assembly of claim 1, wherein said oiling device includes a second articulating means for moving said oiling member into and out of nip contact with said second surface of said fuser member.

8. The smart and virgin contact fuser service assembly of claim 2, including (i) a first supply roll containing and supplying virgin portions of said first continuous web, and (ii) a first take-up roll.

9. The smart and virgin contact fuser service assembly of claim 3, including (i) a second supply roll containing and supplying virgin portions of said second continuous web, and (ii) a second take up roll.

10. The smart and virgin contact fuser service assembly of claim 4, wherein said controller selectably feeds said virgin cleaning portions and said virgin oiling portions on a basis of said measure of a quantity of toner fused by the toner fuser assembly being serviced.

11. The smart and virgin contact fuser service assembly of claim 4, wherein said measure of a quantity of toner fused by the toner fuser assembly comprises a pixel count of toner image pixels.

12. The smart and virgin contact fuser service assembly of claim 5, wherein said second drive assembly is separate from, and controllable independently of, said first drive assembly.

13. The smart and virgin contact fuser service assembly of claim 5, wherein said first drive assembly and said second drive assembly are each a variable speed drive assembly.

14. A toner fuser assembly comprising:

(a) a movable pressure fuser member;

(b) a movable heated fuser member forming a fusing nip with said movable pressure fuser member for receiving, heating and fusing sheets carrying toner images; and (c) a smart and virgin contact fuser service assembly for servicing at least one of said movable pressure fuser member and said movable heated fuser member, said smart and virgin contact fuser service assembly including:

(i) a cleaning device including a cleaning member having virgin cleaning portions on a cleaning surface, said virgin cleaning portions being feedable in a single pass into cleaning contact with a fuser first surface of at least one of said pressure fuser member and said movable heated fuser member;

(ii) an oiling device including an oiling member having virgin oiling portions on an oiling surface, said virgin oiling portions being feedable in a single pass into oiling contact with a second surface of at least the other of said pressure fuser member and said movable heated fuser member; and (iii) a controller connected to said cleaning device and to said oiling device for selectably and periodically feeding said virgin cleaning portions and said oiling portions.

15. The toner fuser assembly of claim 14, wherein said controller includes means for acquiring a measure of a quantity of toner fused by the toner fuser assembly as a condition of said toner fuser assembly.

16. The toner fuser assembly of claim 14, including a first drive assembly for said cleaning device and a second drive assembly for said oiling device.

17. The toner fuser assembly of claim 14, wherein said cleaning device includes a first articulating means for moving said cleaning member into and out of nip contact with said first surface of said fuser member.

18. The toner fuser assembly of claim 14, wherein said oiling device includes a second articulating means for moving said oiling member into and out of nip contact with said second surface of said fuser member.

19. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member for developing said latent electrostatic image on said imaging surface into a toner image;

(d) a transfer station for transferring said toner image from said imaging surface onto an image-carrying substrate; and (e) a toner fuser assembly including a smart and virgin contact fuser service assembly for servicing said toner fuser assembly, the smart and virgin contact assembly comprising:

(i) a cleaning device including a cleaning member having virgin cleaning portions on a cleaning surface, said virgin cleaning portions being feedable in a single pass into cleaning contact with a first surface of at least a fuser member being cleaned;

(ii) an oiling device including an oiling member having virgin oiling portions on an oiling surface, said virgin oiling portions being feedable in a single pass into oiling contact with a second surface of at least a second fuser member being oiled; and (c) a programmable controller connected to said cleaning device and to said oiling device for selectably feeding said virgin cleaning portions and said oiling portions as programmed.

20. The electrostatographic reproduction machine of claim 19, wherein said cleaning device comprises a first web assembly and said cleaning member is a first continuous web.

* * * * *